US005263827A

United States Patent [19]

Esposito et al.

[11] Patent Number: 5,263,827

[45] Date of Patent: Nov. 23, 1993

[54] POLYPHASE FLUID DIAPHRAGAM PUMP

[75] Inventors: Giancarlo Esposito, Florence; Enzo Pagli, Pistoia, both of Italy

[73] Assignees: Nuovopignone-Industrie Meccaniche e Fonderia SpA, Florence; AGIP SpA, Milan, both of Italy

[21] Appl. No.: 931,704

[22] Filed: Aug. 18, 1992

[30] Foreign Application Priority Data

Sep. 6, 1991 [IT] Italy ..... MI91A002369

[51] Int. Cl.[5] ..... F04B 43/06

[52] U.S. Cl. ..... 417/395; 417/383

[58] Field of Search ..... 417/395, 383, 388; 92/99, 98 D

[56] References Cited

U.S. PATENT DOCUMENTS

| | | | |
|---|---|---|---|
| 250,253 | 11/1881 | Johnston | 417/383 |
| 2,919,650 | 1/1960 | Wiggerman | 417/383 |
| 3,391,963 | 7/1968 | Weeks | 417/395 X |
| 4,353,287 | 10/1982 | Weiler | 92/99 |
| 4,784,249 | 11/1988 | Harrison | 92/99 |
| 5,145,331 | 9/1992 | Goes et al. | 417/383 |

FOREIGN PATENT DOCUMENTS

| | | | |
|---|---|---|---|
| 0250026 | 9/1987 | European Pat. Off. . | |
| 3603145 | 8/1967 | Fed. Rep. of Germany | 92/97 |
| 1806675 | 2/1968 | Fed. Rep. of Germany . | |
| 654073 | of 1982 | Switzerland . | |
| 888379 | 6/1960 | United Kingdom . | |
| 887774 | 1/1962 | United Kingdom | 417/388 |

*Primary Examiner*—Richard A. Bertsch
*Assistant Examiner*—Peter Korytnyk
*Attorney, Agent, or Firm*—Morgan & Finnegan

[57] ABSTRACT

A diaphragm pump for gas-containing fluids, in which the chamber for the fluid to be pumped is of frusto-conical shape corresponding to the elastic diaphragm, the minor-diameter edge of which is connected to a rigid central disc provided at its periphery with a frusto-conical support surface for the underlying diaphragm. A protection system is provided for the elastic diaphragm.

1 Claim, 3 Drawing Sheets

POLYPHASE FLUID DIAPHRAGAM PUMP

BACKGROUND OF THE INVENTION

1. Field of the Invention

This invention relates to a new diaphragm pump which by preventing the diaphragm undergoing deleterious abnormal deformation or puckering allows effective, long-lasting and reliable pumping of fluids with any gas content.

2. Description of the Related Art Including Information Disclosed Under 37 C.F.R. §§1.97-1.99

From the state of the art and more precisely from the preceding European Patent No. 0250026 of Apr. 1, 1992 of the present applicant, a device is already known for specifically pumping fluids of high gas content by means of diaphragm pumps, i.e. pumps in which an elastomeric diaphragm separates the fluid to be handled from the hydraulic operating oil. For this purpose said known pumps use substantially hemispherical internal elastic diaphragms having a thickness which decreases from their edge, fixed to the centre plane through the pump casing, to their centre, and are reinforced by embedded fabric and a series of metal rings arranged concentrically parallel to the plane on which the diaphragm is fixed to the pump casing, said rings of the series having a cross-section which decreases from the edge towards the centre of the diaphragm. Experience has shown that this known type of diaphragm pump has a series of drawbacks, of which the most important is related to the arising of abnormal deformation in a critical region of the diaphragm located in proximity to its connection to the pump casing, where failure occurs due to fatigue. In substance, it has been found that following the varying shape assumed by the diaphragm during pump operation, deformation occurs in said critical diaphragm region in the form of wrinkles which travel along said region to cause fatigue failure triggered by small defects which are always present and are difficult to eliminate, even with very careful manufacturing processes. A further drawback of said known diaphragm pump is that the elastic diaphragm presses directly against the holes provided for housing the intake and delivery valves for the fluid to be pumped, the edges of these holes then inevitably fracturing, as has been found in practice.

SUMMARY OF THE INVENTION

The object of the present invention is to obviate said drawbacks by providing a diaphragm pump for pumping gas-containing fluids which does not give rise to any fracturing of the diaphragm. This is substantially attained by using an elastic diaphragm of frusto-conical instead of hemispherical shape, which operates in a lower pump chamber of corresponding frusto-conical shape, said frusto-conical diaphragm being connected by its major-diameter edge to the pump casing and by its minor-diameter edge to rigid central disc provided at its periphery with a corresponding frusto-conical support surface for the underlying elastic diaphragm. Again, as said central disc has a not indifferent mass, its position must always be precisely defined by a rod vertically rigid with the disc, said rod being guided upperly by guides which ensure regular vertical sliding of the disc without any misalignment which could cause undesirable abnormal stressing of the diaphragm.

This reliably obviates the danger of fracture of the diaphragm by the valve holes, these no longer making contact with the diaphragm as they lie below said rigid central disc. In addition, when fluid intake begins, the diaphragm pulled by the action of the hydraulic operating oil does not close in the form of a bag about the disc to create the deleterious puckering, but simply rests on the frusto-conical support surface to hence maintain its shape, its deformation then taking place without the creation of puckering. More specifically, the entire frusto-conical diaphragm rests against the support surface as soon as pulling begins and then separates gradually from said surface and curves towards its connection to the pump casing, until it gradually rests on the cylindrical wall of the upper pump chamber as the disc-rod system is raised towards its upper end-of-travel position.

Hence, the diaphragm pump suitable for gas-containing fluids, comprising a pump casing divided internally by an elastic diaphragm into a lower chamber provided with an intake valve and a delivery valve for the fluid to be pumped, and an upper chamber for the hydraulic operating oil, is characterised according to the present invention in that said lower chamber is of frusto-conical shape with its minor base below, this shape corresponding to the shape of said elastic diaphragm the major-diameter edge of which is connected to the pump casing whereas its minor-diameter edge is connected to a rigid central disc provided at its periphery with a corresponding frusto-conical support surface for the underlying elastic diaphragm, said disc being rigid with a vertical rod guided upperly by vertical guides supported within a turret connected to the top of said upper pump chamber and of such a height as to enable the rod to slide vertically during the entire travel of the plate, said turret being connected to the hydraulic operating oil feeder.

Again, to prevent oil continuing to be drawn from the upper chamber even after the disc has reached the top of its upward travel because of an always possible malfunction of the intake reversal system for the pump hydraulic oil, which in effect has occurred in practice and which by creating a considerable pressure difference between the two chambers would fracture the diaphragm due to excess pressure, according to a further characteristic of the present invention an elastic diaphragm protection device is provided, in the form of a seal ring provided at the top of the upper pump chamber at the mouth of said turret, to cooperate with a shoulder surface rigid with said rod when this latter reaches its upper end of travel position.

In this manner, when the disc and hence the rod reach their upper end of travel position, said shoulder surface makes contact with said seal ring to thus isolate the upper pump chamber so that nothing can happen to the diaphragm even if the hydraulic oil pump should continue to draw.

The invention is described in detail hereinafter with reference to the accompanying drawings, which illustrate a preferred embodiment thereof given by way of non-limiting example in that technical or constructional modifications can be made thereto but without leaving the scope of the present invention.

DESCRIPTION OF THE PREFERRED EMBODIMENT

Figure 1:
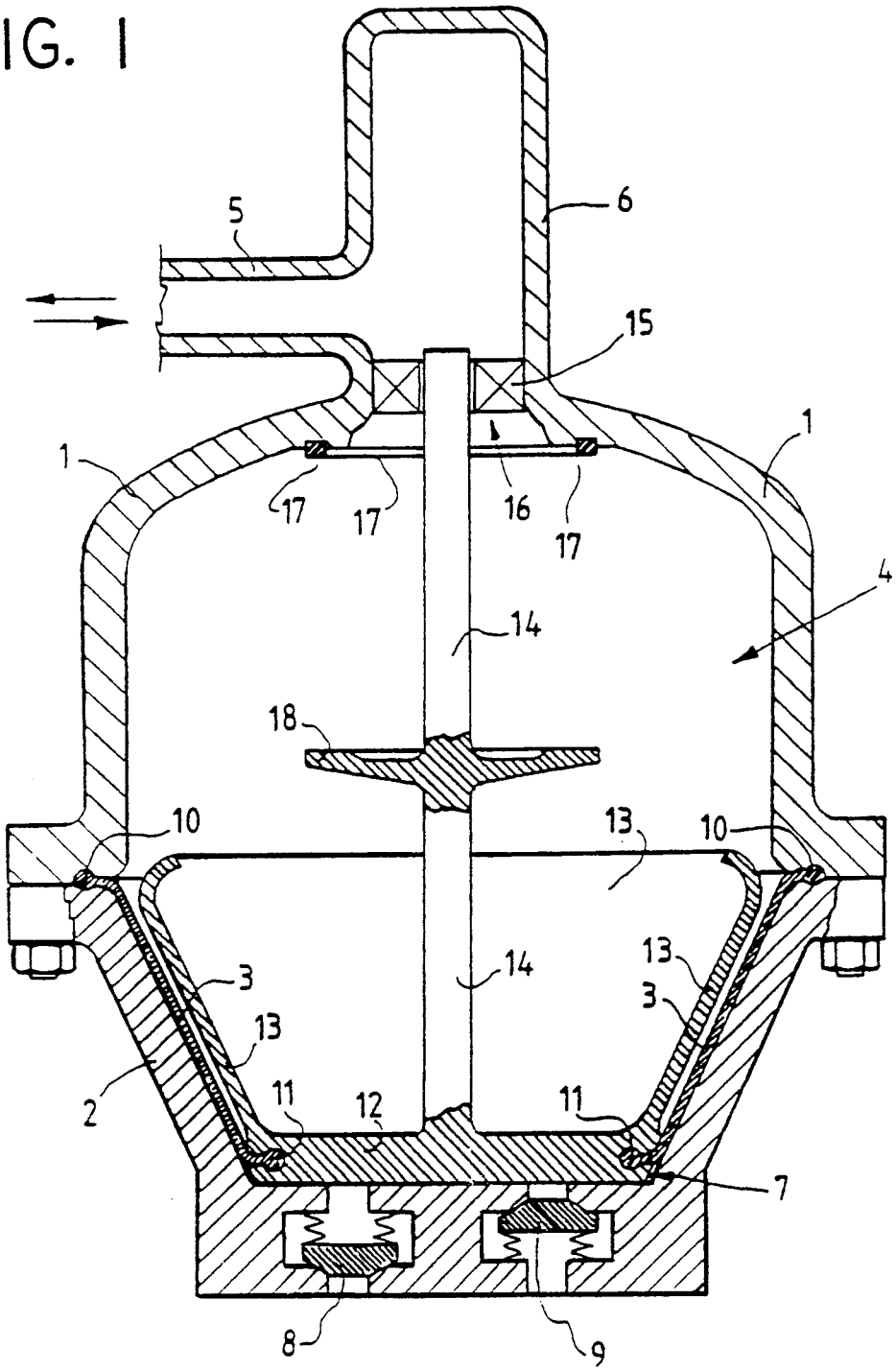
FIG. 1 is a front sectional view of a diaphragm pump constructed in accordance with the invention.

In the figures the reference numerals 1 and 2 indicate respectively the two half-casings which when bolted together form the pump casing within which the elastic diaphragm 3 defines an upper chamber 4 for the hydraulic operating oil, which is conveyed thereto from the feeder, not shown in the figure, via a feed pump, also not shown in the figure, the duct 5 and a turret 6 connected to the top of said upper chamber 4, and further defines a lower chamber 7 of frusto-conical shape with its minor base 7' at the bottom where the intake valve 8 and the delivery valve 9 for the fluid to be pumped are provided.

Said elastic diaphragm 3 is also of frusto-conical shape corresponding to that of the lower chamber 7 and comprises thickened edges 10 and 11 which are inserted into suitable cavities provided in the pump casing 1, 2 and in a rigid central disc 12 respectively. Specifically, the major-diameter edge 10 of the elastic diaphragm 3 is connected to the pump casing 1, 2 and the minor-diameter edge 11 of the diaphragm is connected to said rigid disc 12.

Said rigid central disc 12 is also provided on its periphery with a frusto-conical surface 13 which acts as a support for the underlying elastic diaphragm 3, and is rigid with a vertical guide rod 14 which is itself upperly guided by vertical guides 15 supported in said turret 6, the height of which is such as to enable the rod 14 to slide vertically during the entire travel of the disc 12.

Finally, a seal ring 17 is provided at the top of the upper chamber 4 at the mouth 16 of said turret 6, to cooperate with a shoulder surface 18 rigid with said rod 14.

Figure 2:
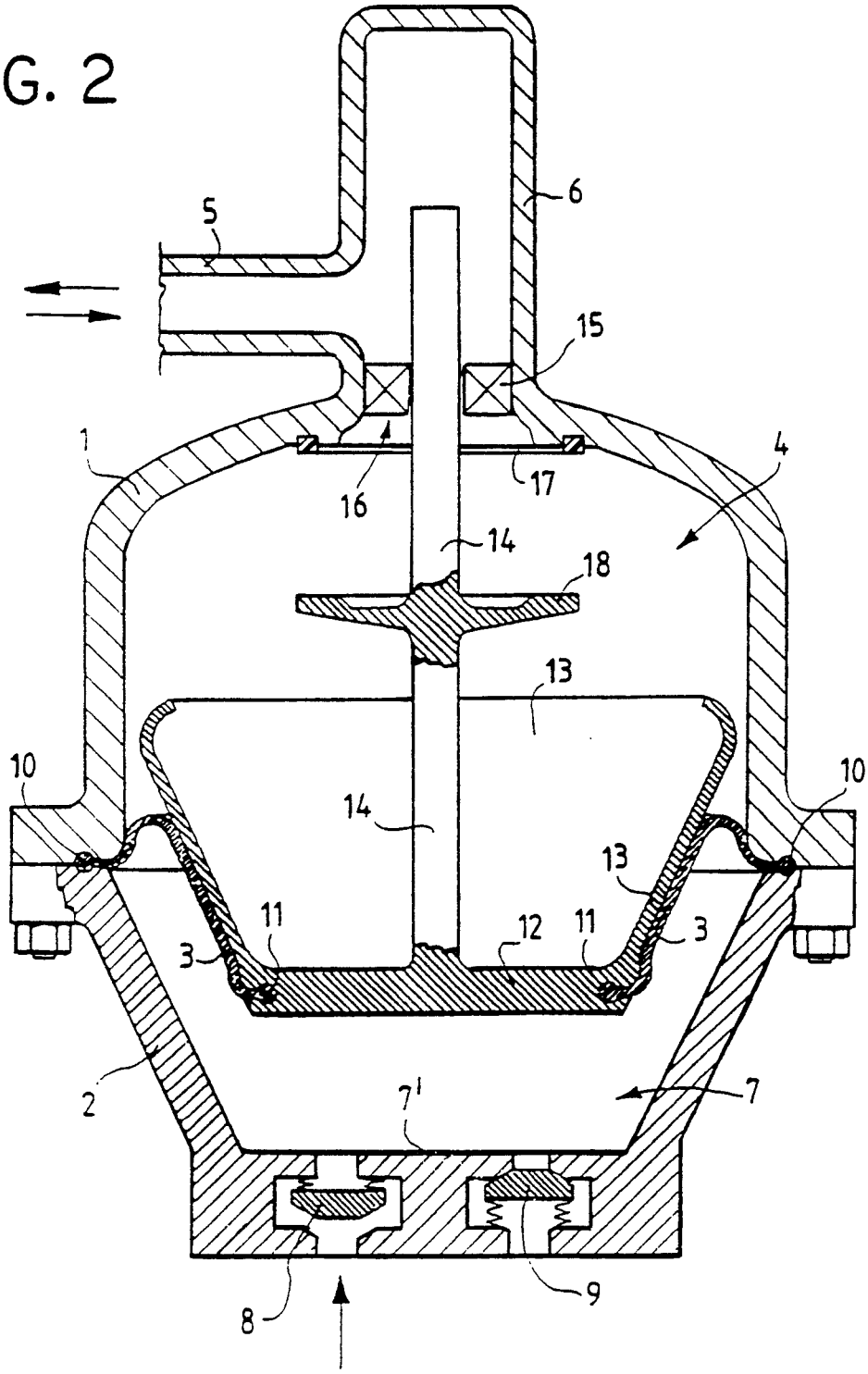
FIGS. 2 and 3 are views analogous to FIG. 1, showing different stages in the operation of the pump according to the invention.
Figure 3:
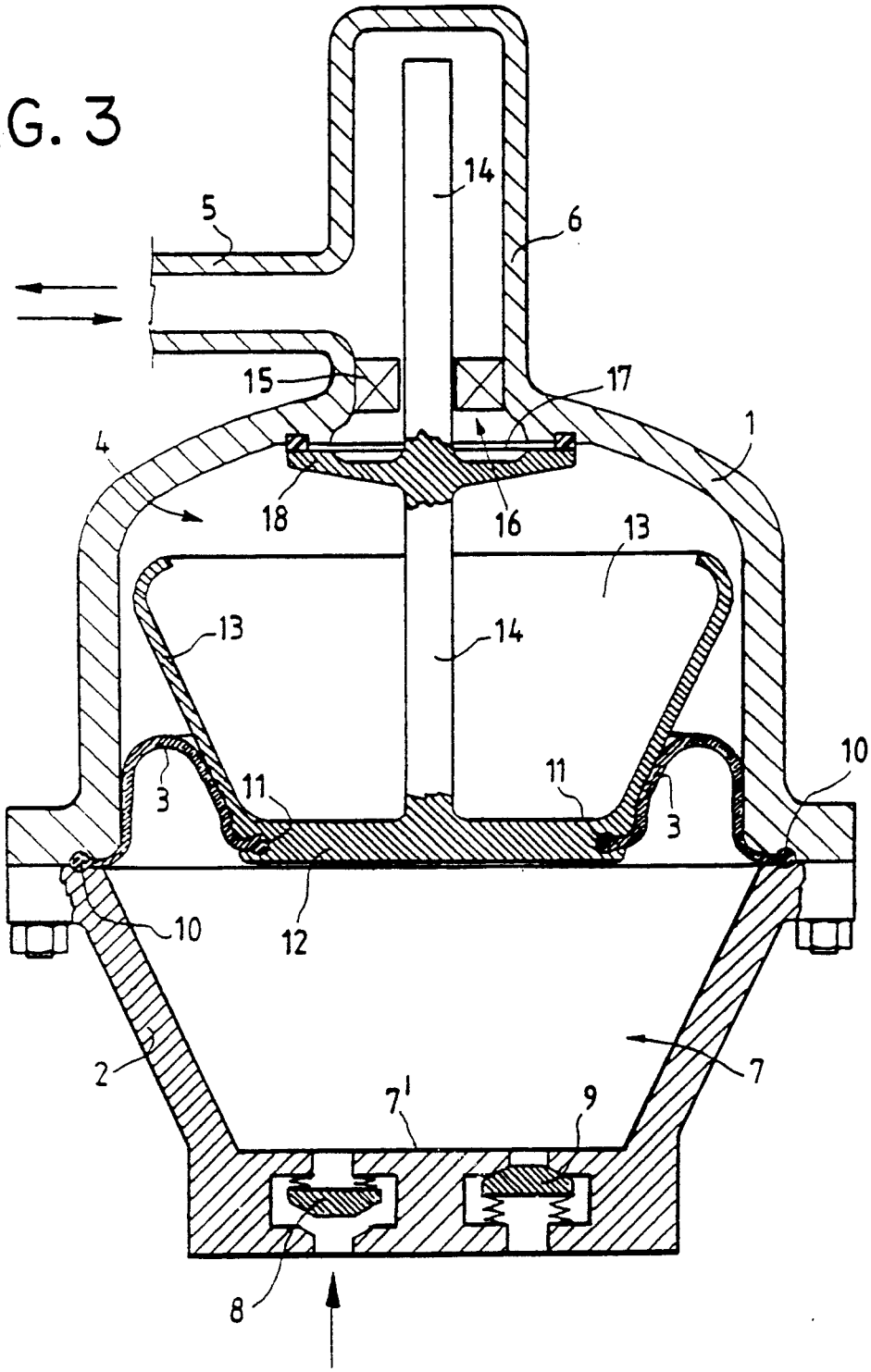

FIGS. 2 and 3 show clearly how the diaphragm 3 curves as it separates progressively from the frusto-conical support surface 13, and how when the diaphragm attains its upper end of travel position (see FIG. 3) the connection between the duct 5 and the upper chamber 4 is interrupted by the protection system formed by the ring 17 and the shoulder surface 18.

We claim:

1. A diaphragm pump suitable for gas-containing fluids, comprising a pump casing divided internally by an elastic diaphragm into a lower chamber provided with an intake valve and a delivery valve for the fluid to be pumped, and an upper chamber for the hydraulic operating oil, characterized in that said lower chamber is of frusto-conical shape with its minor base below, this shape corresponding to the shape of said elastic diaphragm the major-diameter edge of which is connected to the pump casing whereas its minor-diameter edge is connected to a rigid central disc provided at its periphery with a corresponding frusto-conical support surface for the underlying elastic diaphragm, said disc being rigid with a vertical rod guided upperly by vertical guides supported within a turret connected to the top of said upper pump chamber and of such a height as to enable the rod to slide vertically during the entire travel of the plate, said turret being connected to the hydraulic operating oil feeder, a seal ring is provided at the top of the upper pump chamber at the mount of said turret, to cooperate with a shoulder surface rigid with said rod when this latter reaches its upper end of travel position.

* * * * *